US009010755B2

(12) United States Patent
Ortmann et al.

(10) Patent No.: US 9,010,755 B2
(45) Date of Patent: Apr. 21, 2015

(54) PRINTER APPARATUS

(71) Applicants: Axel Ortmann, Berlin (DE); Wolfgang Muhl, Hohen Neuendorf (DE)

(72) Inventors: Axel Ortmann, Berlin (DE); Wolfgang Muhl, Hohen Neuendorf (DE)

(73) Assignee: Francotyp-Postalia GmbH, Birkenwerder (DE)

( * ) Notice: Subject to any disclaimer, the term of this patent is extended or adjusted under 35 U.S.C. 154(b) by 97 days.

(21) Appl. No.: 13/945,038

(22) Filed: Jul. 18, 2013

(65) Prior Publication Data

US 2014/0020576 A1 Jan. 23, 2014

(30) Foreign Application Priority Data

Jul. 18, 2012 (DE) ..... 10 2012 014 901
Jun. 21, 2013 (DE) ..... 20 2023 005 632 U

(51) Int. Cl.

| | |
|---|---|
| ***B65H 5/02*** | (2006.01) |
| ***B65H 5/04*** | (2006.01) |
| ***B41J 13/12*** | (2006.01) |
| ***B41J 11/00*** | (2006.01) |

(52) U.S. Cl.

CPC ..... *B41J 13/12* (2013.01); *B41J 11/0035* (2013.01)

(58) Field of Classification Search

CPC .... B65H 5/062; B65H 2601/11; B65H 29/12; B65H 2511/22; B65H 2511/224

USPC ..... 271/264, 275, 276, 273, 274

See application file for complete search history.

(56) References Cited

U.S. PATENT DOCUMENTS

| | | | | |
|---|---|---|---|---|
| 7,810,810 | B2 | 10/2010 | Hantel et al. | |
| 2001/0028146 | A1 * | 10/2001 | Takata | 271/274 |
| 2005/0070434 | A1 * | 3/2005 | Drake | 503/227 |
| 2012/0120172 | A1 | 5/2012 | Ortmann et al. | |
| 2012/0147071 | A1 | 6/2012 | Ortmann et al. | |

FOREIGN PATENT DOCUMENTS

| | | |
|---|---|---|
| CA | 2797331 A1 | 6/2013 |
| DE | 897383 | 5/1962 |
| DE | 3810132 C1 | 9/1989 |

* cited by examiner

*Primary Examiner* — Prasad Gokhale
(74) *Attorney, Agent, or Firm* — Schiff Hardin LLP

(57) ABSTRACT

A printer apparatus has a contact pressure device for flat articles on a continuously moving transport belt, in particular letters in a franking and/or addressing machine. In order to increase the usable region and/or of the throughput of the printer apparatus, flat articles of different thicknesses are processed with predetermined speed, without slippage, in succession with arbitrarily small gaps between successive articles. An elastic, bellows-shaped, resiliently supported air bag has a low-friction, wear-resistant cover surface that is in non-positive contact with the transport belt. With its associated retention and air supply devices the bellows serves as a mobile contact pressure module.

20 Claims, 13 Drawing Sheets

A-A

Detail B

Detail C

PRINTER APPARATUS

BACKGROUND OF THE INVENTION

1. Field of the Invention

The invention concerns a printing apparatus according of the type that is equipped to print to flat goods to be printed during the passage of flat goods by a printer unit. The printing apparatus can be used in a mail processing system, in particular in a franking and/or addressing machine. The goods are letters and other mail items or flat articles.

2. Description of the Prior Art

In known franking machines, contact pressure elements are used that press the mail good from below against a transport direction that is situated above, and direct the mail items past the print head for printing. For example, elastically borne counter-pressure rollers; counter-pressure elements made of elastic elements in the form of leaf springs; elastically borne flat ribbon belts are used as counter-pressure elements.

A device for printing to flat goods at a transport module is already known from U.S. Pat. No. 7,810,810 B2, which has a number of contact pressure elements that act on the flat good with a spring force through an opening in a feed table of an apparatus. The contact pressure elements are designed as lowerable elastic elements and anchored in a lower housing shell of the apparatus. For example, an actively driven flat ribbon belt for the transport of the flat item is provided as a transport direction in the upper housing shell of the apparatus. Due to the suspension of every single contact pressure element, the possibility advantageously exists of mixed mail processing of different mail goods of 0.1 to 10 mm and more that can follow closely in series (i.e. with a short interval between the mail goods) and enable a high throughput of the franking machine.

In this contact pressure device, it is disadvantageous that the mail item is pressed from below against the flat transport belt only in a line, or in points. Even with a number of contact pressure elements, a flat contact pressure against the flat transport belt situated above is not achieved; only an approximation of this ideal state is possible. Transport disruptions (such as shocks and delays) that negatively affect the print quality occur upon running into the individual contact pressure elements.

A device to lower, position and raise contact pressure elements of a printing apparatus is known from the German Utility Model DE 20 2010 015 351 U1. This device is arranged in a box-shaped module that can be slid like a drawer into the printing apparatus or can be slid out from the printing apparatus. The contact pressure device is elastically mounted on a base plate in the housing of the box-shaped module. The box-shaped module has two guide holders for guide rods or rails for sliding in the box-shaped module, a rocker to lower the contact pressure elements, and shaped parts that interact with the contour of the guide rods for lowering, positioning and raising the contact pressure elements of the contact pressure device in order to initially move the contact pressure device backwards into the printing apparatus while sliding the box-shaped module into the printing apparatus, and to move the contact pressure device forwards towards a transport direction upon reaching a predetermined position. The contact pressure device has brush-like contact pressure elements.

A contact pressure device with sprung elastic contact pressure elements is likewise known from the German Utility Model DE 20 2011 109 208 U1. This contact pressure device presses the mail item over its entire surface against the overlying flat transport belt with a double-spring brush element. A transport disruption no longer occurs in the printing process due to the many, densely arranged brush elements, and a high print quality is achieved even given letter thicknesses up to 10 mm.

Brush elements of a brush body are mechanically coupled with a spring system that in turn has a number of spring elements. The brush elements themselves are typically flexurally elastic to a limited extent. The brush elements compensate for the thickness difference up to a thickness of the mail goods of 3 mm. The entirety of the brush body is additionally elastically lowered at thicknesses as of 3 mm. The brush body is attached to a base plate that is in turn borne in a spring-biased manner on a floor plate that is elastically connected with a chassis. The spring elements are arranged between the base plate and the floor plate as well as between the base plate and the chassis. When a letter arrives between brush body and transport belt, the brush body as a whole is distanced from the transport belt by the letter thickness minus the brush element curvature. Given letters of approximately the same thickness, the detection of the subsequent letter is certain, even if the preceding letter has not yet left the contact pressure region. However, if a thin letter (1 mm thick) follows a thick letter (10 mm thick), the risk exists that the thin letter will not be detected as long as the thick letter is still located in the contact pressure region. For such cases (mixed mail), it must be ensured that a letter may only arrive in the contact pressure region when the preceding letter has exited said contact pressure region.

Otherwise, given the processing of a thick mail items and thin mail items in immediate succession, a flat contact pressure of the thin mail item is not ensured. This leads to poorer printing results. In order to process the mail items of different thickness with a uniformly good print quality, an interval (for instance in brush body lengths) between the successive mail items is necessary. The design of the brush element therefore requires a minimum gap, i.e. a minimum letter interval of approximately one brush body length between the flat mail items in order to ensure the uniform contact pressure. This means either reducing the letter throughput and increased control cost, or exclusion of mixed mail. Given significantly non-uniform letter contents, a complete compensation of such non-uniform thicknesses does not occur, such that the print quality can suffer.

Given subdivision of the brush body analogously to the roller bearing, the risk in turn exists of transition shocks and slippage, with subsequent consequences for the print quality.

A printing apparatus of modular design is described in addition to the contact pressure described above in DE 20 2010 015 354 U1. In an upper part of the printing apparatus, a transport module is arranged which has an actively driven, revolving transport belt. In the lower part of the printing apparatus, the box-shaped module is provided with a contact pressure device to press against flat articles (letters). During the printing, the flat article is transported clamped between the transport belt and the contact pressure device. The module is slid into the operating mode and can be removed from the printing apparatus in service mode. This arrangement is therefore subsequently designated as a mobile contact pressure module.

SUMMARY OF THE INVENTION

An object of the invention is to increase the usage range and the letter throughput of a printing apparatus.

The invention is based on the object of developing a contact pressure device suitable for mixed mail processing—in particular for letter thicknesses from 0.1 to 10 mm—that enables a high print quality of the printing apparatus.

It is a further object to achieve a contact pressure device of the aforementioned type in a modular design with which flat articles of different thicknesses can be processed more quickly than the one-piece-at-a-time manner described above.

A high throughput of flat goods should be achieved by the printing in the printing apparatus. The printing apparatus should be characterized by an affordability and functional security, inexpensive servicing and user-friendliness, and a low noise emission.

The printing apparatus according to the invention has a mobile contact pressure module with a contact pressure device that is provided to press flat articles against a roller driven, continuously moving transport belt, wherein the transport belt is arranged in an upper part of the printing apparatus and the mobile contact pressure module is arranged in its lower part. A flat article is transported between the transport belt and the mobile contact pressure module. The contact pressure device has a gas-tight shell that can be elastically inflated such as an elastic, bellows-shaped, resiliently supported air bag that has a low-friction, wear-resistant cover surface that is not firmly connected with the transport belt. The air bag and the associated retention and air supply devices are a component of the mobile contact pressure module, which can be exchangeable. A floor frame, at least two tension springs and a function arm with a microswitch mounted thereupon, as well as a compression swing, are mounted as a retention device inside a housing of the mobile contact pressure module. The function arm is attached at one of its ends to the floor frame so as to be rotatable around a bearing axle, and is pressed at its other end against a stop by the spring force F1 of the compression spring in the operationally ready state of the mobile contact pressure module. In the removal-ready state of the mobile contact pressure module, upon a movement counter to the action of the spring force F1, the function arm can be brought out of its stop. The elastic, inflatable, gas-tight shell has an upper part and a lower part, as well as a middle part, with the middle part being attached to an upper part of the housing of the contact pressure module, and the upper part of the shell penetrating through a window opening into the upper part. A floor plate is mounted at the floor of the lower part of the contact pressure device, and the at least two tension springs are tensioned between the floor plate and the floor frame or the upper part, so the tension springs together exert an spring force F2 on the surface of the floor plate in order to urge the floor plate onto stops to limit travel, and therefore onto the microswitches. Each microswitch is activated until the spring force F2 is greater than or equal to the sum of pre-tension $F\mathbf{2}_{pre}$ and the resulting force effect $F=\Delta P \cdot A$ (wherein $\Delta P$ is the gas pressure difference between internal gas pressure and external pressure, and a is the effective surface of the shell). The minimum contact pressure force of the contact pressure device is established by the pre-tension $F\mathbf{2}_{pre}$ of the tension springs. The elastic constant c of the tension springs is selected so as to be equal to the quotient of the difference $\Delta F=F\mathbf{2}_{max}-F\mathbf{2}_{pre}$ and the maximum deflection $a_{max}$ of the floor plate.

A circuit board, equipped with a time delay circuit, is arranged inside the housing. The circuit board has a power connection to supply the circuit board with an operating voltage when the mobile contact pressure module is in an inserted state, and a connector electrically connected to the output of the time delay circuit so as to provide that output to the contacts of a motor of a pump. The circuit board also has a connector that electrically connects an input of the time delay circuit with the contacts of the microswitch. The time delay circuit of the circuit board detects activation of the microswitch and omits, as an output a time-delayed signal to the motor of the pump; but, in the state in which the mobile contact pressure module is removed, the pump remains unpowered, so the pump is started with a time delay when the function arm is brought to a stop, and gas is then pumped into the shell of the contact pressure device as long as the output signal is emitted. The operationally ready state of the mobile contact pressure module thus is set with a time delay.

The stops for travel limitation are provided at a predetermined distance D from the running surface of the flat articles on the upper part of the housing. The operation of the microswitch is interrupted when the floor plate moves away from the stops for travel limitation and a minimum distance $a_{min}$ from the stops is thereby exceeded.

The printing apparatus allows printing of mixed mail with letter thicknesses in a region from 0.1 to 10 mm, even when a mail piece with a minimum letter thickness follows a mail piece with a maximum letter thickness in immediate succession, with a minimum gap between the mail pieces. The contact pressure module has a shell filled with a gas as a component of the contact pressure device, advantageously an air-filled, rubber elastic bellows system. The side walls of the shell are designed to be dimensionally stable while the cover surfaces (contact pressure surface and floor surface) execute a travel movement when the internal gas pressure rises. The width of the contact pressure surface of the contact pressure device transverse to the transport direction is smaller than or equal to the length of the straight segment of the transport belt. The inventive contact pressure device advantageously has the same dimensions as the contact pressure device with brush elements that are known from the German Utility Patent DE 20 2010 015 351 U1. In that known pressure control device, however, the contact pressure device is supported on the lower part of the contact pressure module housing. In contrast to this, in accordance with the invention a middle part of the bellows is mounted in the upper part of the contact pressure module housing, and the bellows has two assembled halves that rest gas tight on the middle part or on one another and internally allow a pressure compensation. Given an increase of the internal gas pressure, such a bellows system allows an expansion of the shell essentially in a preferred direction, so a current flat article to be transported that rests with its underside on a contact pressure surface of the bellows and is pressed against a transport device. The transport direction proceeds across the contact pressure module and the article is actively driven.

Upon intake of flat articles—for example mail items—the pressure relationships in the bellows system change. The contact pressure surface of the bellows is deformed depending on the mail item thickness. A higher air pressure within the bellows system thereby arises that is compensated by the elastically mounted, lowerable floor plate that forms the floor of the bellows. The tension springs that are tensioned between the floor plate and a floor frame are thereby forced to extend (stretch) beyond their nominal extent.

If mail pieces with lower thickness are transported again, the contact pressure surface can rapidly adapt its shape solely by the stretched tension springs acting between the floor plate and the floor frame. Via the air pressure in the bellows system, the contact pressure surface of the bellows can promptly rest on flat transport belt after the mail item. Smaller intervals (gaps) between the mail items are thereby possible and a higher throughput is achieved. Particularly in the processing of mixed mail, this is an advantage compared to a contact pressure device with brush elements.

A slide coating with low friction is applied to the contact pressure surface, while the transport belt is equipped with a surface that has a higher friction. A mail item is therefore safely transported. The noise emission remains below the average in such printing apparatuses.

Upon inflation of the bellows by means of a pump, for example a small electric air piston pump or membrane pump, the bellows presses its contact pressure surface against the actively driven flat transport belt. The bellows and the transport belt are in non-positive connection, meaning that despite the contact between the bellows and the transport belt, the transport belt still moves substantially unimpeded. At the same time, a travel movement of the floor plate is executed downward. A predetermined force F2 that counteracts the travel movement is exerted by the tension springs.

Given transport of a thick mail item and an immediately following thin mail item, the contact pressure surface of the bellows is deformed more significantly as the gap between the mail items is reduced. For example, the flat mail items can be letters that immediately follow one another at a distance of approximately 50 mm. The length of the contact pressure device in the transport direction is, for example, four times the gap, and thus approximately corresponds to the mean letter length (235 mm) of a standard or compact letter. The throughput is also consequently increased. Given a minimum letter gap and short letter lengths of approximately 160 mm, a doubling of the throughput of letters with different thicknesses but the same format can thus be achieved.

If the internal air pressure $P_{intern}$ has reduced after some time, due to a leak of the bellows system or due to an increase of external air pressure $P_{extern}$, a required overpressure in the bellows system can then be established again with the aid of a delayed two-point regulation. As used herein, "regulation" is a process in which the control variable—the gas pressure $P_{intern}$ within the shell—is changed in a desired manner due to external influences or disruptions given a deviation from a desired value $F_{desired}=F2+A\cdot P_{extern}$ with A=active surface. The energy of the control variable itself is sufficient to pneumatically produce an adjustment of the control device via the lower part of the shell.

DESCRIPTION OF THE PREFERRED EMBODIMENTS

The representation is executed schematically at least in part for simplification and for an easier comprehension. For the purpose of brevity, "letter" is used instead of the term "flat article" in the following.

Figure 1:
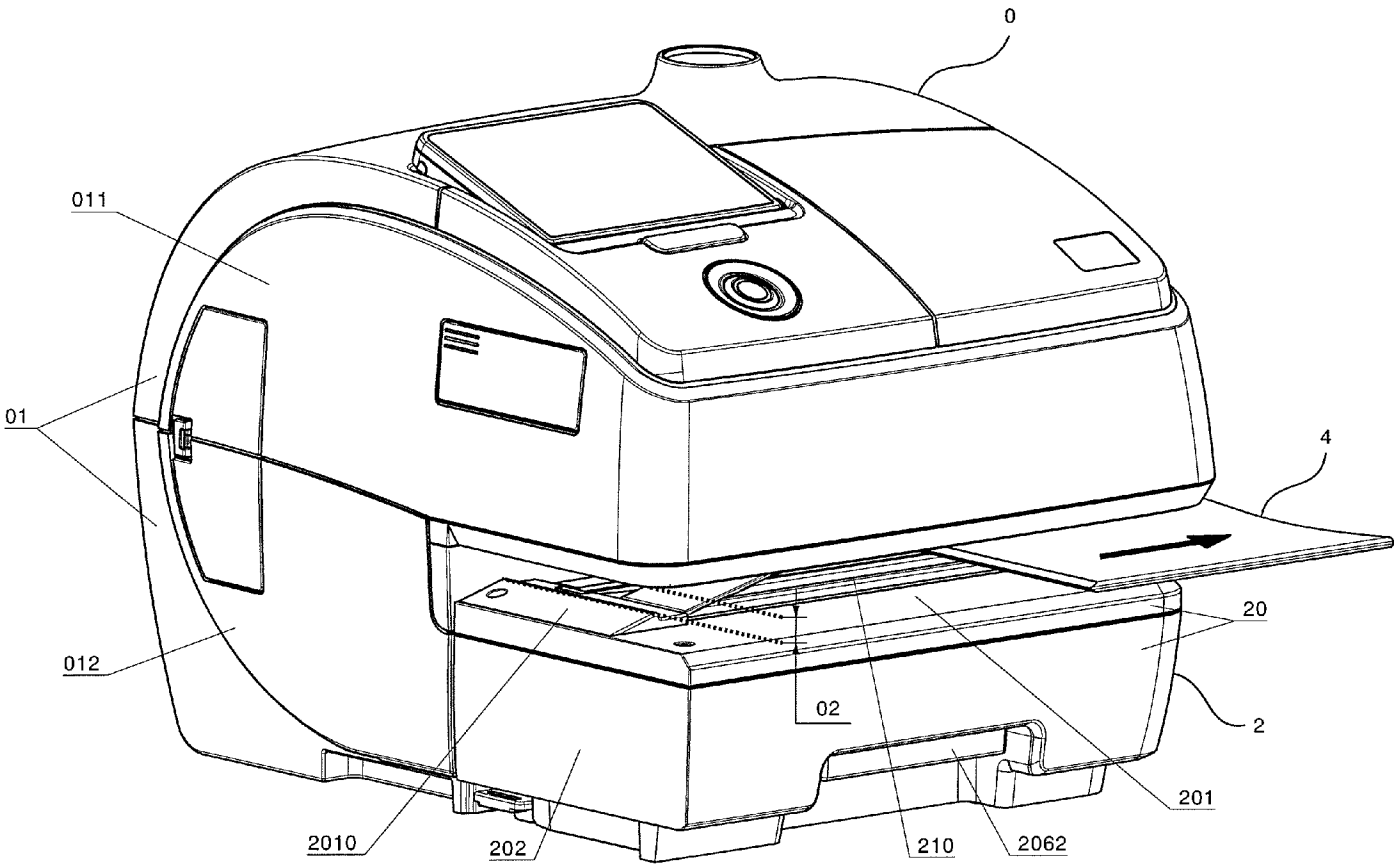
FIG. 1 is a perspective view of a franking machine with inserted contact pressure module, from the front left.

A franking machine 0 with an apparatus housing 01, a contact pressure module 2 and a letter 4 in the output region (see transport direction arrow) is shown in FIG. 1. The apparatus housing 01 is composed of an upper part 011 and a lower part 012 and encloses an apparatus carrier 03 with accessories; see also FIG. 2 in this regard.

The contact pressure module 2 is a mobile component of the lower part of the franking machine 0. The contact pressure module housing 20 comprises an upper part 201 and a lower part 202.

The input region 02 of the franking machine 0 forms what is known as the letter thickness sluice. The letter thickness sluice 02 is bounded at the top by a shaped part 031 and at the bottom by a shaped part 2010; see also FIG. 2.

The air supply to the bellows-shaped air bag 210 is interrupted when the grip 2062 of the function arm 206 is pressed (see in this regard FIG. 7), and the air bag 210 deflates. The air bag 210 sinks downward, such that a clearance from the transport belt 10 is created. The contact pressure module 2 can be extracted toward the front at the grip 2062.

Figure 2:
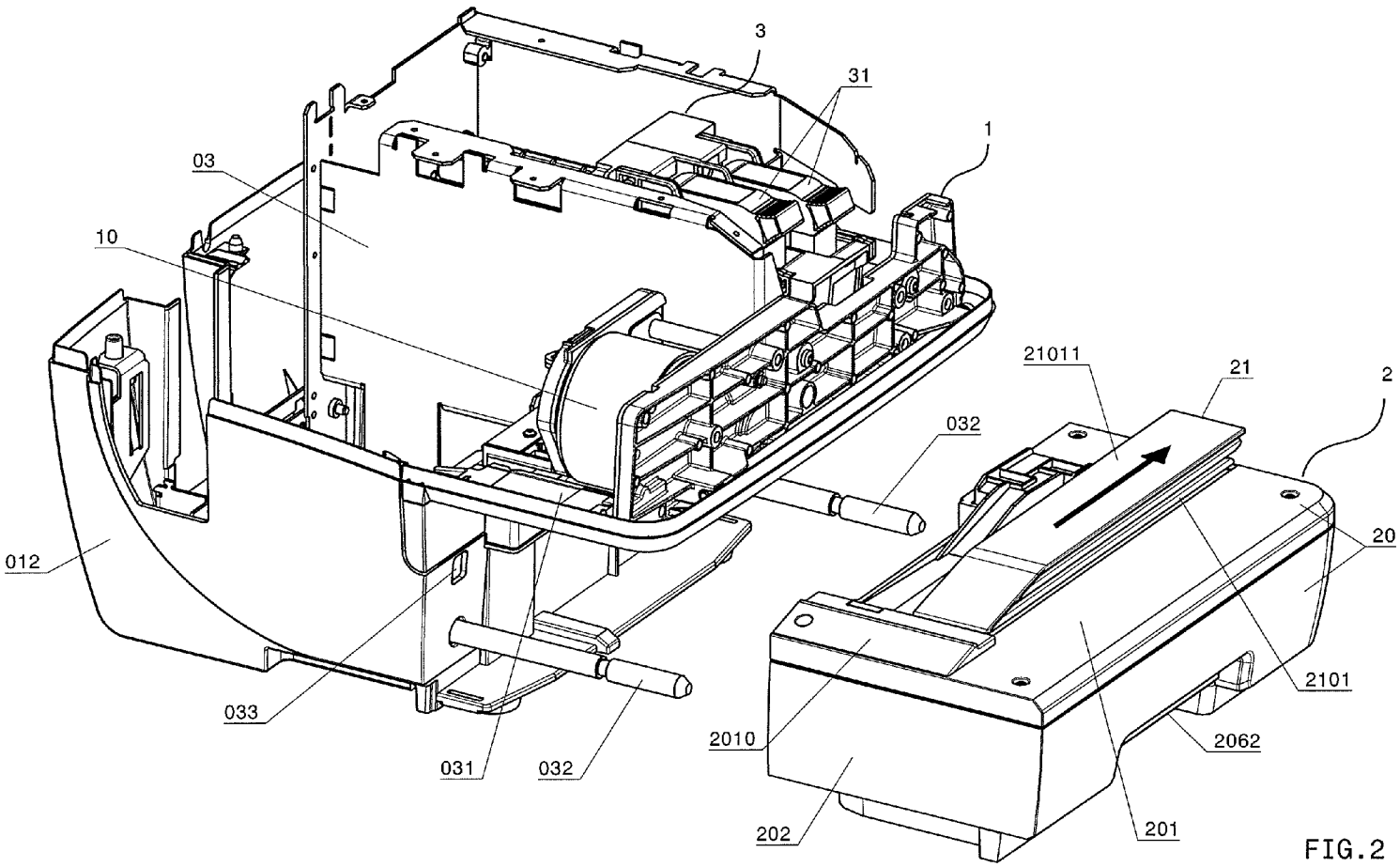
FIG. 2 is a perspective view of the franking machine according to FIG. 1 without the upper apparatus housing and with the contact pressure module removed.

A franking machine 0 with removed upper apparatus housing 011 (see FIG. 1) and removed contact pressure module 2 is shown in FIG. 2. In the lower apparatus housing 012, an apparatus carrier 03 is attached in which the transport module 1 with the transport belt 10 and the printing module 3 with the print heads 31 are arranged. The contact pressure module 2 can be connected with the lower region of the franking machine mechanically via guide rods 032 and electrically via a connector bushing 033.

The contact pressure module 2 has contact pressure device 21 in a two-part housing 20. The horizontal surface of the upper part 201 of the contact pressure module housing 20 simultaneously forms the letter travel surface in addition to the cover surface 21011 of the air bag 210. The grip 2062 of the aforementioned function arm 206 is located in the lower part 202 of the contact pressure module housing 202.

Figure 4:
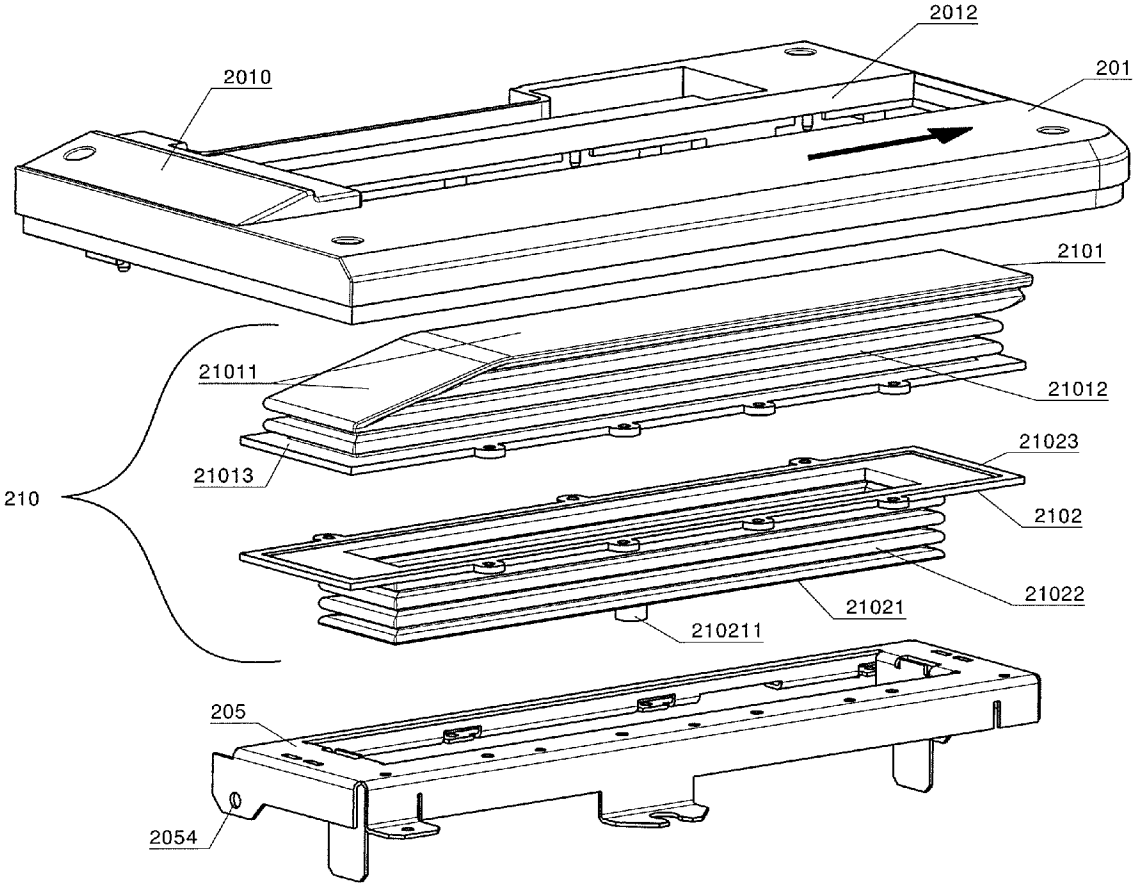
FIG. 4 is a perspective view of the predominant upper part of the contact pressure module from the front above left, in an exploded representation.

The cover surface 21011 of the upper part 201 of the air bag 210 is lowered like a wedge in the forward region, counter to the letter travel direction (see arrow), and is provided with a low-friction, wear-resistant coating (Teflon®, for example); see also FIG. 4.

Figure 2A:
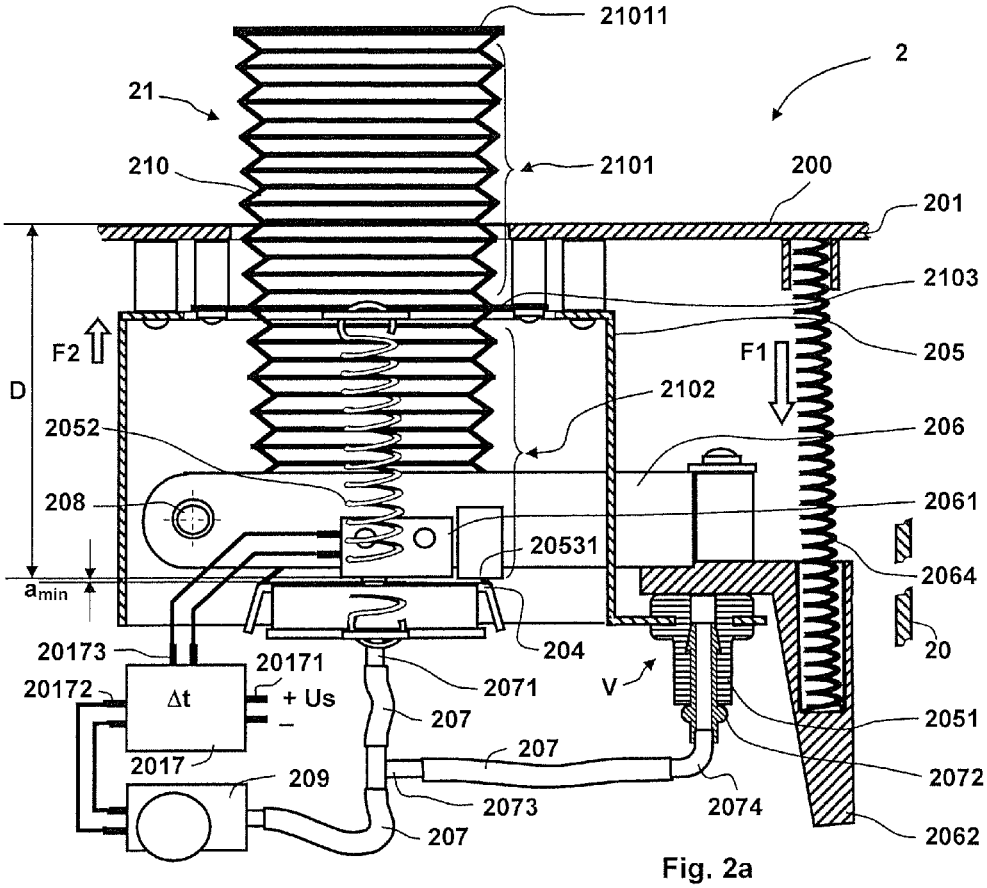
FIG. 2*a* is a sectional view of the basic design of the inventive contact pressure device from the left (feed side).

A principle design of the contact pressure device is shown from the left (feed side) in section presentation (as viewed from the feed side) in FIG. 2*a*. A floor frame 205, at least two tension springs 2052 and a function arm 206, with a microswitch 2052 and a compression spring 2064 mounted thereupon, are provided inside a housing 20 of the mobile contact pressure module 2. At one of its ends, the function arm 206 is attached to the floor frame 205 so as to be rotatable around a bearing axle 208, and at its other end it is pressed against a stop by the spring force F1 of the compression spring 2064 in the operationally ready state of the mobile contact pressure module 2. The stop is formed by a rubber pad at the floor frame 205 and by a portion of the handle 2062. In the removal-ready state of the mobile contact pressure module 2, given a movement counter to the action of the spring force F1 the function arm 206 can be brought out of its stop. The contact pressure device 21 has an elastic, inflatable, gas-tight shell 210 with an upper part 2101 and a lower part 2102, as well as a middle part 2103, wherein the middle part 2103 is attached to an upper part 201 of the housing 20 of the contact pressure module 2. The upper part 2101 protrudes through a window opening into the upper part 201. A floor plate 204 is mounted at the floor of the lower part 2101 of the contact pressure device 21. The at least two tension springs 2052 are tensioned between the floor plate 204 and the floor frame 205 or the upper part 201. The tension springs together exert an spring force F2 on the surface of the floor plate, wherein the spring force F2 is sufficiently large to draw said floor plate 204 onto stops 20531 (and therefore onto the microswitch 2061), at least in the inserted state of the mobile contact pressure module 2. The microswitch 2061 is activated until the spring force F2 is greater than or equal to the sum of pre-tension $F2_{pre}$ and the resulting force effect $F=\Delta P \cdot A$, with the gas pressure difference $\Delta P$ between internal gas pressure and external pressure, as well as with the effective surface A of the shell, wherein the minimum contact pressure force of the contact pressure device 21 is established by the pre-tension $F2_{pre}$ of the tension springs, and wherein an elastic constant c of the tension springs is selected which is equal to the quotient of the difference $\Delta F=F2_{max}-F2_{pre}$ and the maximum deflection $a_{max}$ of the floor plate 204. At the maximum spring force $F2_{max}$, a maximum contact pressure force is achieved that leads to maximum deformation of the shell. The pre-tension $F2_{pre}$ of the tension springs can be variably selected. The maximum elastic tension $F2_{max}$ that is reached upon maximum deflection $a_{max}$ of the tension springs can be selected with regard to a maximum weight and/or dimension of the flat article. For example, the maximum spring force $F2_{max}$=14 N, the pre-tension $F2_{pre}$=4 N and the maximum deflection $a_{max}$=10 mm. An elastic constant c=1 N/mm results from this for the tension springs.

Arranged inside a housing 20 is a circuit board 2017 with a time delay circuit. A power connector 20171 of the circuit board to supply the circuit board with an operating voltage in the inserted state of the mobile contact pressure module 2; a connector 20172 of the circuit board for electrical connection of an output of the time delay circuit with the contact of a motor of a pump 209; and a connector 20173 of the circuit board for electrical connection of an input of the time delay circuit with the contacts of the microswitch 2061 are provided, wherein the time delay circuit establishes an activation of the microswitch 2061 and outputs a time-delayed signal to the motor of the pump, but remains unpowered when the mobile contact pressure module 2 is in the removed state. It is provided that the time delay circuit is designed for a separate adjustment of the time delay of the activation delay and the deactivation delay. Upon the function arm 206 being brought into a stop, the pump 209 is started with a time delay and gas is pumped into the shell of the contact pressure device 21 as long as the signal is emitted, wherein the operationally ready state of the mobile contact pressure module 2 is set with a time delay. Stops 20531 are provided at a predetermined distance D from the travel surface 200 of the flat articles on the upper part 201 of the housing 20. The activation of the microswitch 2061 is interrupted when the floor plate 204 moves away from the stops 20531 (backwards travel in the direction of the floor of the housing) and a minimum clearance $a_{min}$ from the stops is thereby exceeded (see FIG. 2). At the same time, the upper part 2101 of the elastic, inflatable, gas-tight shell 210 extends upward in the direction of a transport belt (see FIG. 3). The forwards travel of the upper part 2101 is upwardly limited by the transport belt in that the surface of the upper part 2101 arrives at a stop with the transport belt. A wear-resistant, coated cover surface 21011 on the upper part 2101 of the elastic, inflatable, gas-tight shell 210 serves as a stop surface. The coating increases the sliding capability between the stop surface and the surface of the actively driven transport belt or, respectively, of the flat article.

A hose connector 2071 can be inserted into a gas intake and gas outlet opening in the floor of the lower part 2102 of the elastic, inflatable, gas-tight shell 210 and be connected via at least one hose 207 with the valve to relieve a gas overpressure. Alternatively, a hose connector 2071 can be omitted if a T-part 2073 is connected at one side (via hose 207) with the hose connector 2071 and at the other side directly with the hose connector 2072. A gas outlet opening of the pump 209 is likewise connected with the T-part via a hose 207. Before achieving the operating mode, a lower edge of the microswitch 2061 lies at a minimum distance $a_{min}$ from the floor plate 204, in contrast to FIG. 2*b*.

Figure 2B:
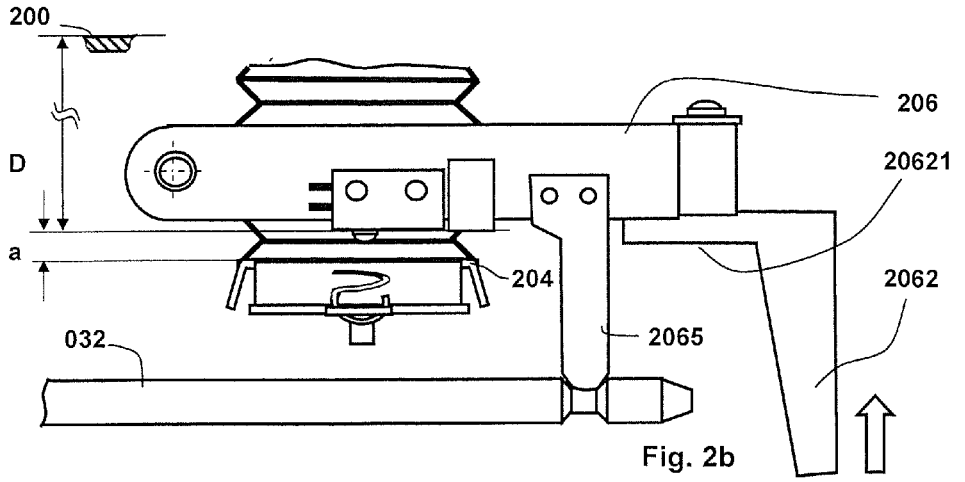
FIG. 2*b* is a view of the basic design of the operating means of the contact pressure device from the left.

A view of a principle presentation of the operating means 206, 2062 and 20621 of the contact pressure device from the left is shown in FIG. 2*b*. Due to the gas overpressure achieved in the operating mode, the floor plate 204 experiences a deflection a; a=3 mm is advantageously the clearance from the stops 20531. The microswitch 2061 is no longer activated given a deflection $a>a_{min}$.

In the operating mode of the printing apparatus, the contact pressure module 2 cannot be removed from the printing apparatus. In this case—in the shown manner—a rocker that can be moved in rotation around a bearing axle is engaged in notches of two guide rods 032. An engagement in notches of two guide rods already arises in principle from the German Utility Model DE 20 2010 015 351 U1.

An opening of a ventilation valve takes place manually via the operation of the function arm 206 by means of the grip part 2062, wherein the function arm 206 is borne such that it can rotate around the bearing axle 208. The ventilation valve comprises a sealing surface 20621 and a hose bushing 2051, wherein the hose bushing 2051 is arranged on one leg of the handle 2062.

Upon operating the handle 2062 in the arrow direction (white arrow), the following three functions are executed:

1. opening of the valve to release the overpressure in the shell, 2. movement of the microswitch away, out of its operating position, whereby the pump is deactivated and the shell remains unpressurized, 3. disengaging of retention means of the contact pressure module from the notches in the two guide rods before removal of the contact pressure module.

Figure 2C:
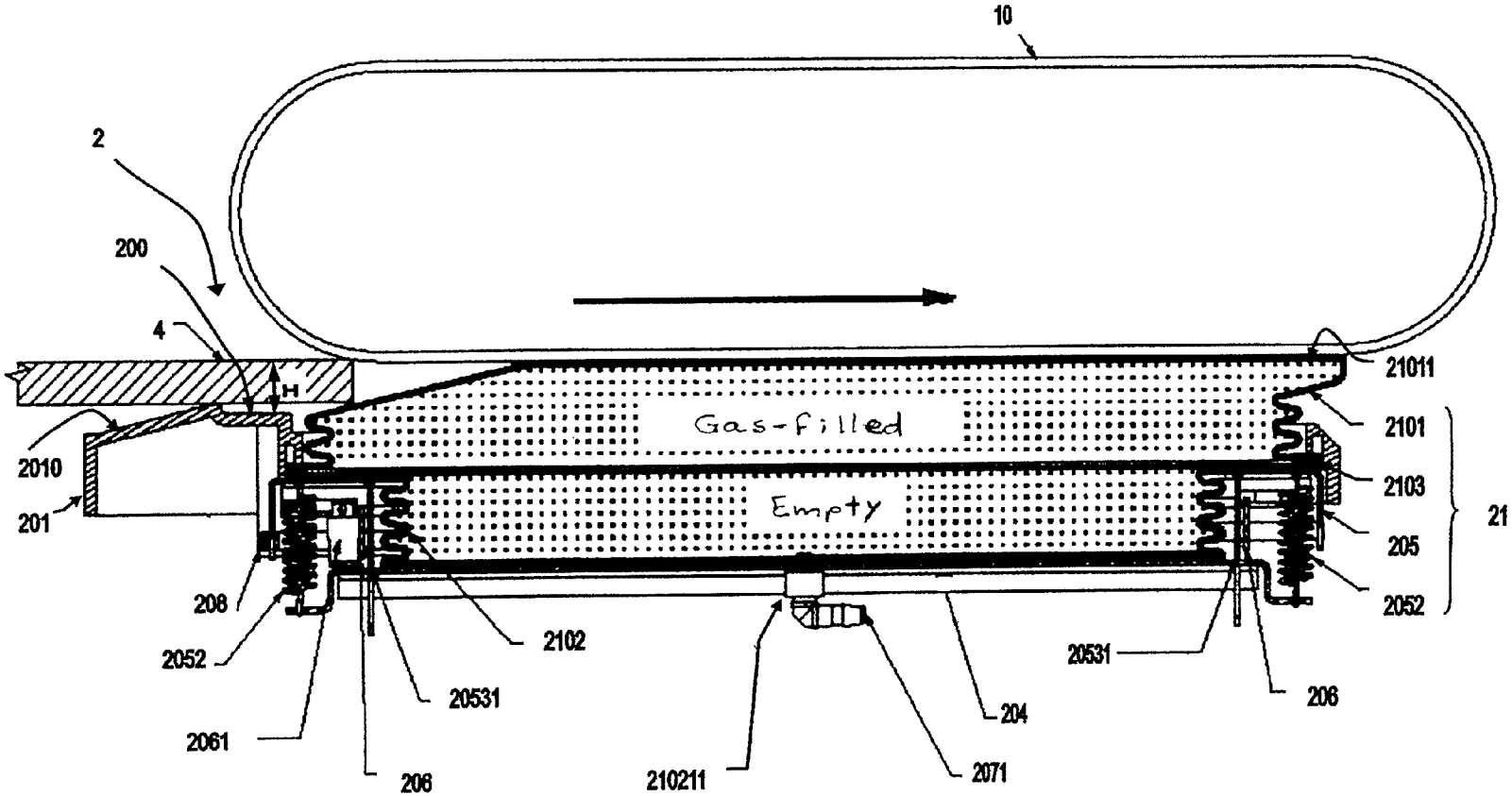
FIG. 2*c* is a sectional view of the basic design of the printing apparatus with a contact pressure device, from the front.

A principle design of the printing apparatus is shown in FIG. 2*c* with the contact pressure device in section presentation, as viewed from the front side. The contact pressure device 21 has an elastic, inflatable, gas-tight shell—advantageously a bellows system filled with air. The shell has an upper part 2101 and a lower part 2102 that are connected with one another via a middle part 2103 so as to be gas-tight. A transport belt 10—shown in simplified form—is realized as a flat transport belt, for example, and is mounted in the printing apparatus at a defined height interval H from the running surface 200 of the flat articles on the upper part 201 of the housing given a deflated bellows system, wherein the height interval is defined by the maximum possible letter thickness.

From the feed side, an upper part 201 of a housing of the contact pressure module 2 has a shaped part 2010 at the mail input side, which shaped part 2010 forms a slope in the letter travel surface. A cover surface 21011 of the upper part 2101 of the bellows forms the contact pressure surface of the contact pressure device. The cover surface likewise has at the mail input side a slope on which an edge of a flat mail good runs, whereby a force is exerted on the contact pressure device 21. In the bellows, the air pressure consequently increases (see also FIG. 2*a*). If the contact pressure module 2 is slid into the printing apparatus (the manner is not shown), the non-sloped letter travel surface of the upper part 201 lies at a fixed height interval H from the approximately parallel segment of the transport belt that is over this. In the upper part 201, the two bellows parts 2101, 2102 are arranged relative to another and attached with their middle part 2103 to a floor frame 205 so that a gas-tight void (represented with a dot pattern) arises between the upper bellows part and the lower bellows part. An opening (which cannot be shown in this Figure) is introduced into the letter travel surface. The upper part 2102 of the bellows protrudes through this opening in the direction of the transport belt 10.

The lower part 2102 of the bellows has a hose connection 210211 with hose connector 2071 to the air inlet and outlet, and is connected with a hose (not shown). Arranged below the lower part 2102 of the bellows is the sprung floor plate 204 with spring suspension. Guide clips 2053 are curved up from the floor frame 205. These interact with slots (which cannot be shown in this Figure) in the floor plate 204 that serve to guide said floor plate 204 when the bellows system is moved due to gas pressure. The guide slips have shoulders that form stops 20531 in order to limit the travel upon movement of the lower part 2102, with the movement directed toward the travel surface. In the operating mode of the printing apparatus, the contact pressure module 2 cannot be removed from the printing apparatus, as has already arisen from the German Utility Model DE 20 2010 015 354 U1. In this case, the U-shaped plate rocker 206 that is movable in rotation around the bearing axle (see FIG. 2*a*) is engaged, as arises from FIG. 2*b*.

Figure 3:
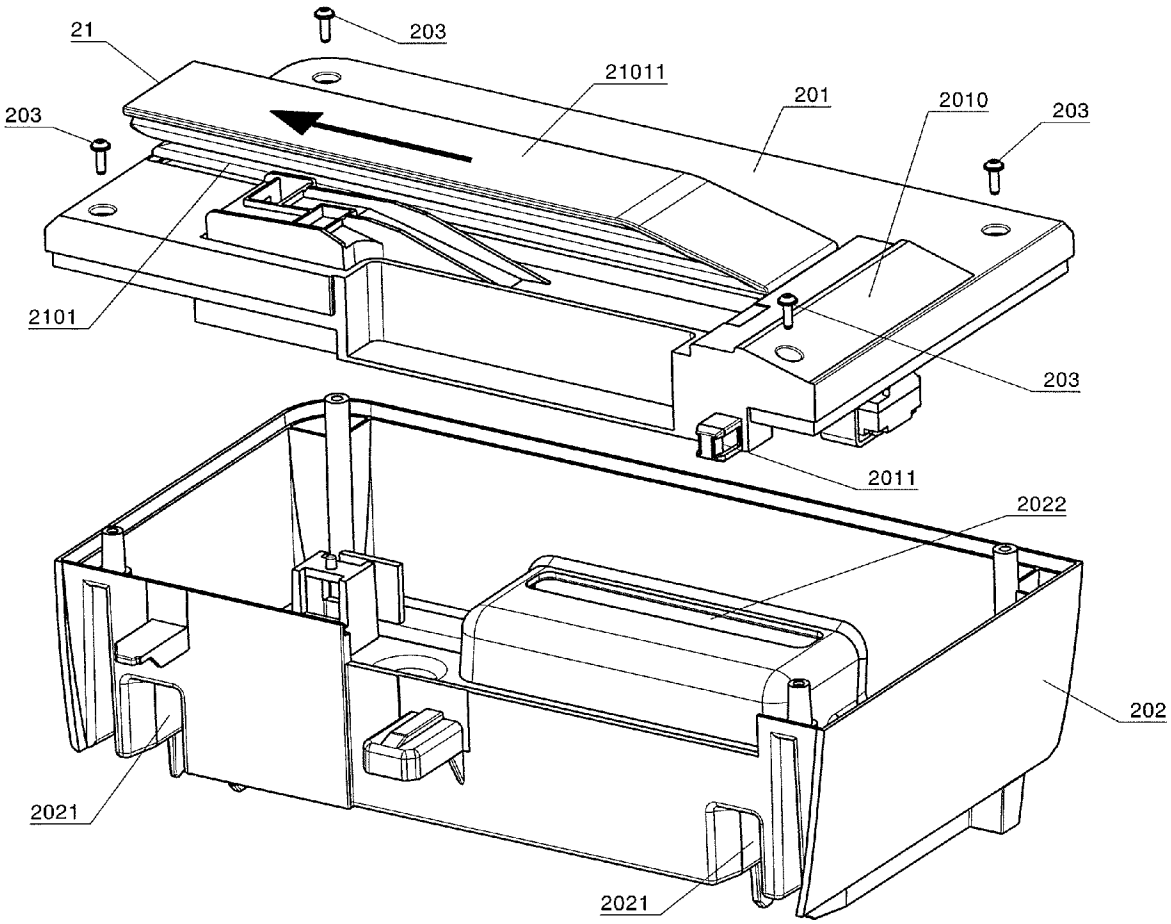
FIG. 3 is a perspective view of the contact pressure module from the rear above left, partially in an exploded representation.

A perspective view of the contact pressure module from the upper rear left—partially in an exploded view—is shown in FIG. 3. Both parts 201, 202 are attached to one another by means of connection bolts 203. Openings 2021 for the guide rods 032 (see also FIG. 2) are provided on the back side of the lower part 202. A plug 2011 as a counterpart to the connection bushing 033 is present on the back side of the upper part 201. Moreover, a box-shaped recess 2022 for the grip 2062 is introduced into the lower part 202.

The upper part of the contact pressure module 2 (shown in FIG. 1) in addition to the floor frame 205 is visible in an exploded presentation in FIG. 4, from the front upper left. The bellows-like air bag 210 comprises an upper part 2101 and a lower part 2102. The sealing surface 21013 of the upper part 2101 and the sealing surface 21023 of the lower part 2102 are adapted to one another. The side parts 21012 of the upper part 2101 and the side parts 21022 of the lower part 2102 are executed in a folded manner. A hose connector 210211 protrudes from the floor surface 21021 of the lower part.

The upper part 201 of the contact pressure module housing 20 (see also FIG. 2) accommodates the bellows-like air bag 210 and the floor frame 205. A shaped part 2010—letter thickness sluice, below—is provided at the intake region for the letters 4. Furthermore, a recess 2012 is molded for the upper part 2010 of the air bag 210. Bores 2054 to accommodate a bearing axle 208 for the function arm 206 (see also FIG. 6) are present on both sides in the floor frame 205.

Figure 5:
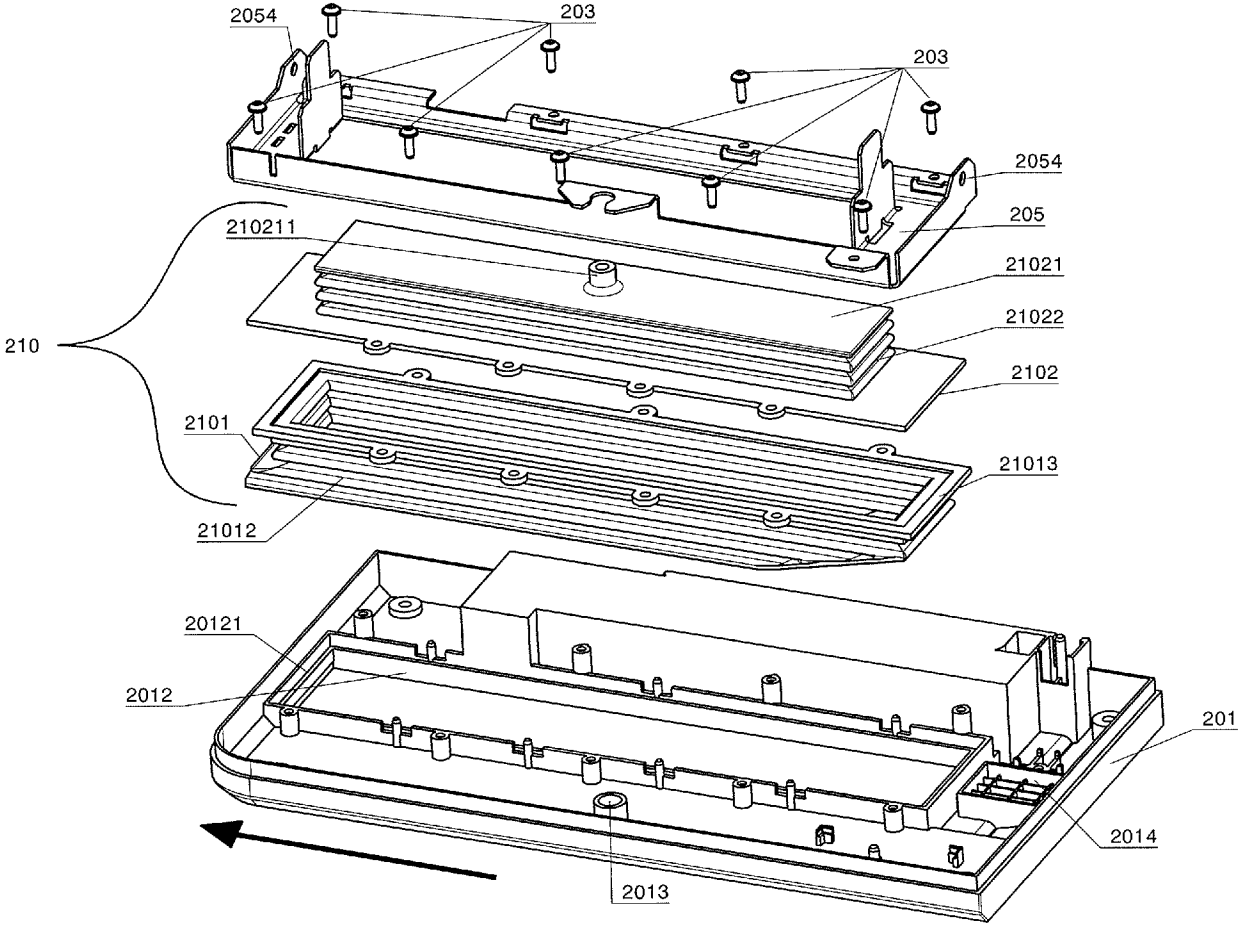
FIG. 5 is a perspective view of the predominant upper part of the contact pressure module from the front bottom left, in an exploded representation.

The parts according to FIG. 4 are presented in exploded form from the front lower left in FIG. 5. All parts are assembled with accurate fit by means of the connecting bolts 203 and the associated guide elements (not designated in detail) and are attached to the upper part 201 of the contact pressure module housing 20 (shown in FIG. 2). The connection between upper part 2102 and lower part 2012 of the air bag 210 is air-tight.

The air bag 210 could also be a single (unitary) part.

Moreover, a support pocket 2014 for a pump 209 (see also FIG. 7) is molded into the upper part 201.

Figure 6:
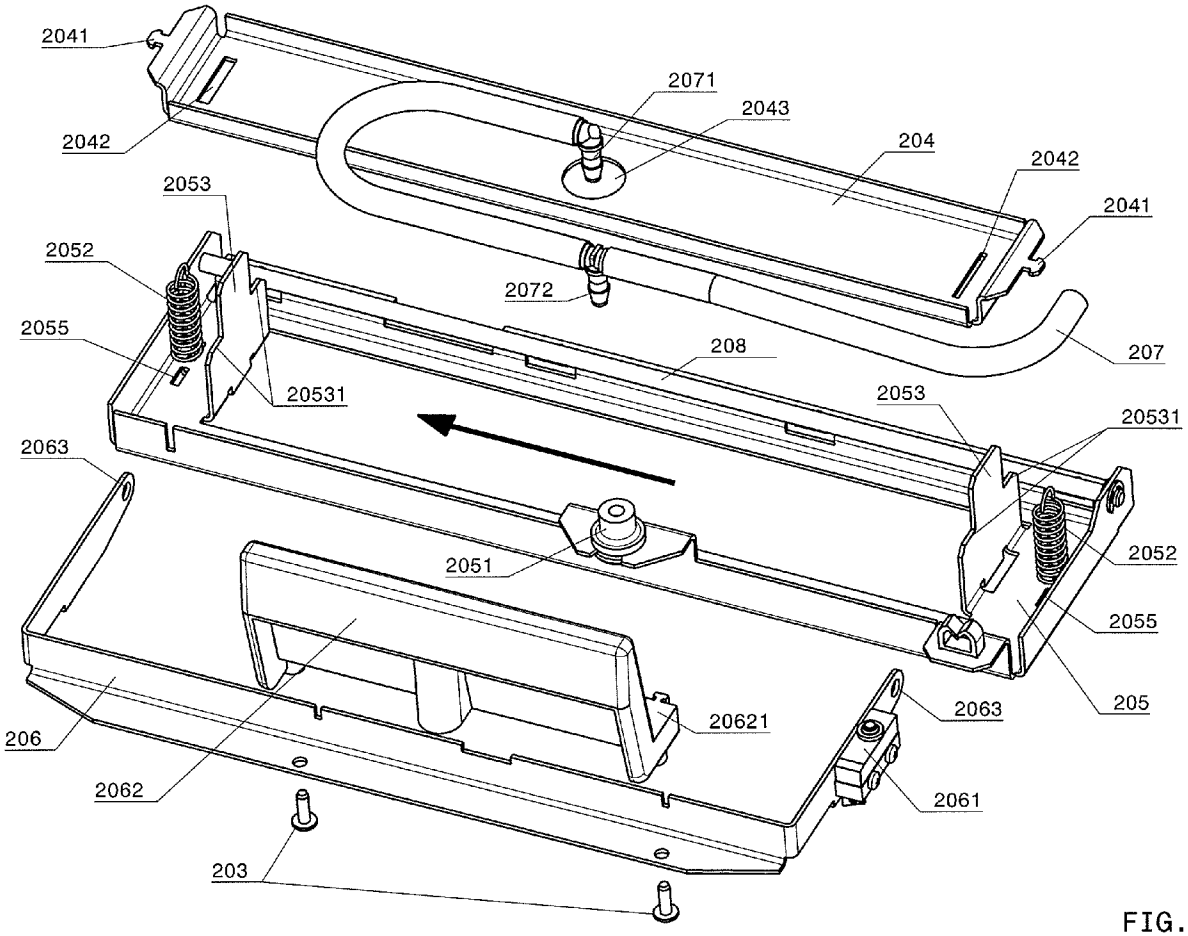
FIG. 6 is a perspective view of the lower part of the contact pressure module from the front lower left, in exploded representation.

The lower part of the contact pressure module 2 (shown in FIG. 2) is presented in exploded form from the rear lower right in FIG. 6. It comprises the floor plate 204, the aforementioned floor frame 205 in addition to the function arm 206, and associated bearing axle 208 and hose 207. Dog-shaped mounts 2041 for tension springs 2052 are provided at the side angles of the floor plate 204. An exposure 2043 for the hose connector 2071 to the hose connection 210211 at the air bag 210 (see also FIG. 5) is introduced in the middle of the floor plate 204. The other end of the hose 207 is connected via a T-shaped hose connector 2072 with a pump 209 (see FIG. 7) whose middle part descends into a rubber elastic hose bushing 2051. The hose bushing 2051 is grasped in a bend of the floor frame 205. The outgoing end of the hose bushing 2051 can be sealed air-tight at the grip 2062 of the function arm 206 by means of an elbowed sealing surface 20621.

The grip 2062 is attached to a U-shaped part of the function arm 206 by means of bolts 203. The free ends of the U-shaped part have bearing holes 2063 for a bearing axle 208 that is in turn borne in lateral bends of the floor frame 205 (see also FIG. 4).

A microswitch 2061 for the activation of the pump 209 is attached to the arm of the U-shaped part at the input side of the apparatus. Floor plate 204 and floor frame 205 are elastically connected with one another via the tension springs 2052. Angled guide clips 2053 in the floor frame 205 serve for defined positioning relative to one another, which guide clips 2053 dip on the one hand into slots 2042 of the floor plate 204 and on the other hand serve as a stop for said floor plate 204. For this purpose, the guide clips 2053 have shoulders 20531. The floor plate 204 slides on the free ends of the guide clips 2053, whose length with the shoulders 20531 establishes the amount of travel (stroke). The combination of slots 2042 and guide clips 2053 requires that the air bag 210 can be displaced only in the vertical direction.

Figure 7:
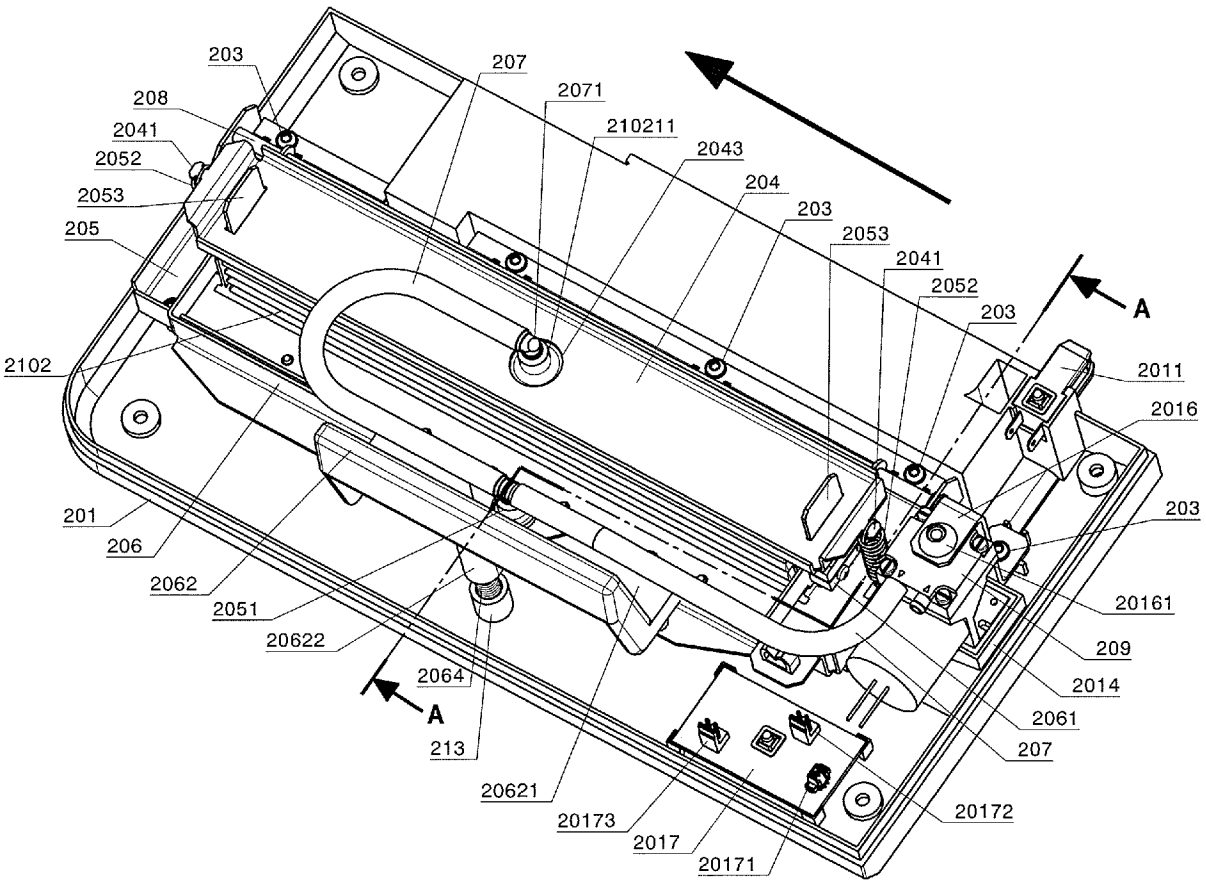
FIG. 7 is a perspective view of the upper part of the contact pressure module from the front lower left.

The arrangement and attachment of the upper part of the contact pressure module 2 (shown in FIG. 2) together with accessories (such as circuit board 2017, plugs 20171, 20172, microswitch 2061 and pump 209) are visible in FIG. 7 in the upper part of the contact pressure module housing 201.

Figure 8:
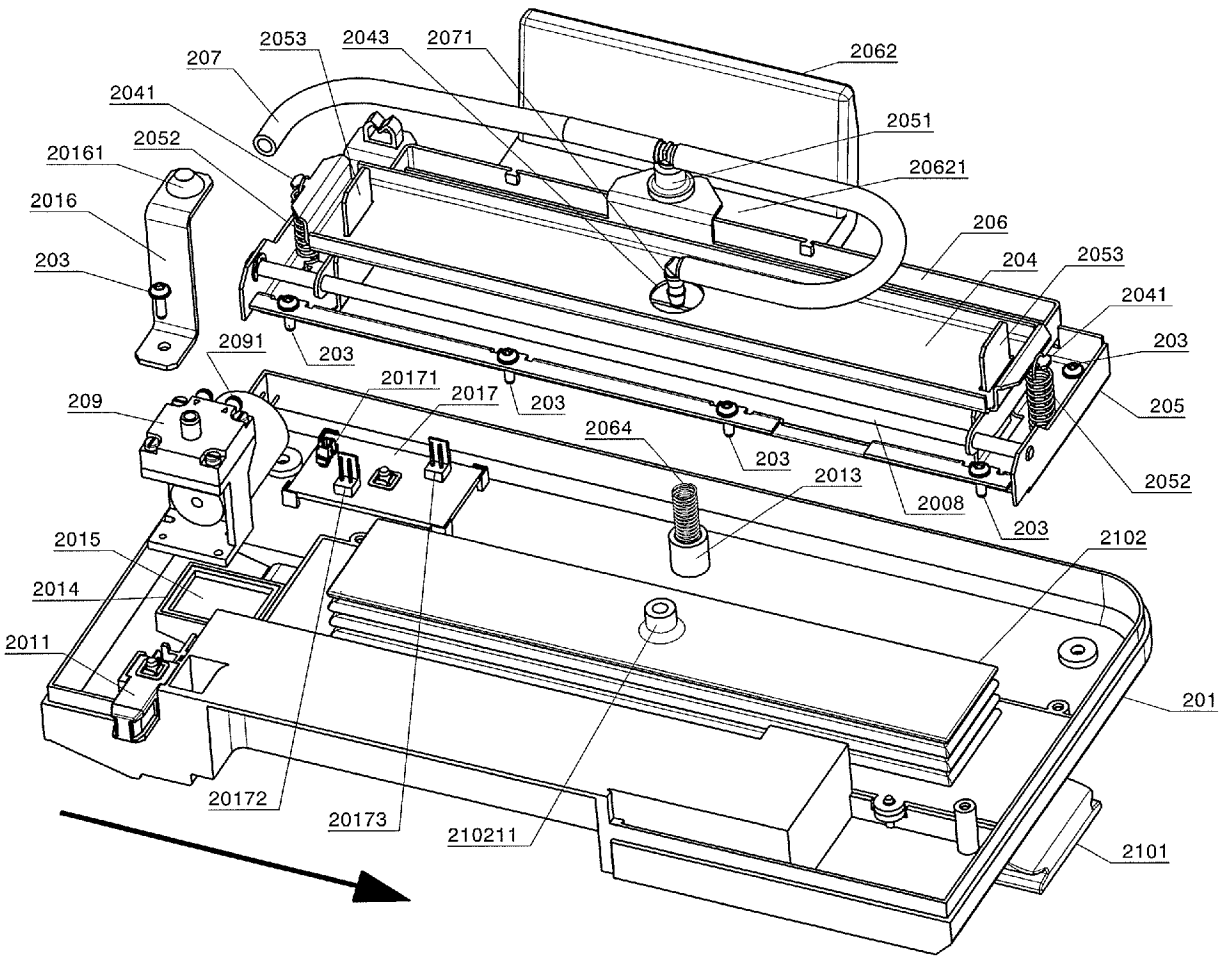
FIG. 8 is a perspective view of the upper part of the contact pressure module from the rear lower left.

In FIG. 8 it is clear how the pump 209 including bearing bracket (not designated in detail) is attached to the upper part 201 so as to damp structure-borne sound. For this purpose, a vibration damper 2015 that prevents a sound transmission to the upper part 201 is provided in the support pocket 2014. Also for such damping, a retention angle 2016 that is firmly bolted to the upper part 201 is provided, on its end facing away, with a vibration damper 20161 that is positively and non-positively connected with the other side of the pump 209. Both pump noise and oscillation transmission from the contact pressure module housing 20 to the transport belt 10—which can have the consequence of disadvantageous effects on the letter transport, and therefore on the print quality—are therefore prevented.

The circuit board 2017 is provided with its own power connection 20171 and with an electrical connection 20172 for the pump 209, and a connection 20173 for the microswitch 2061. The circuit board 2017 is furthermore provided with an electronically adjustable deactivation delay for the pump 209.

Figure 9:
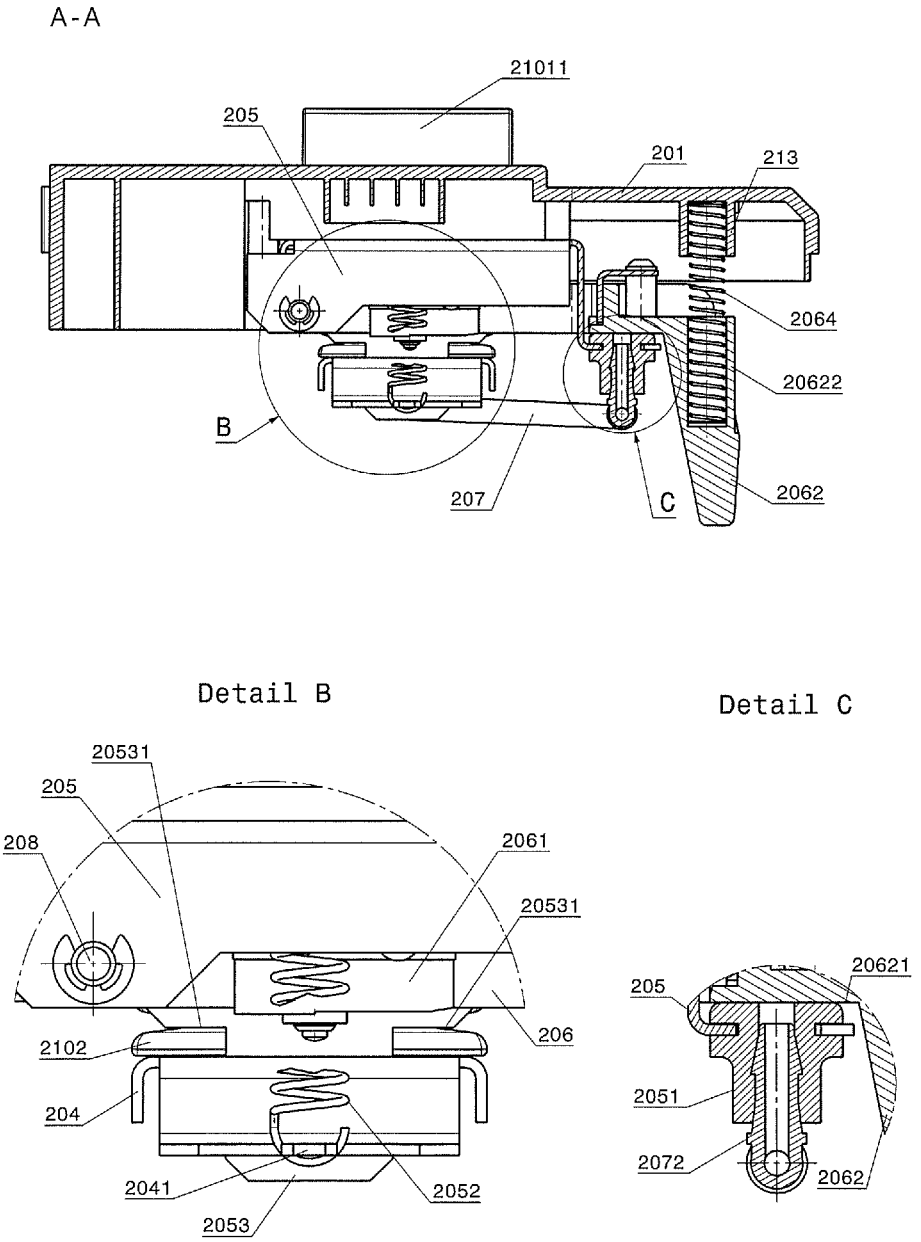
FIG. 9 shows an incremental cross-section presentation of the contact pressure module in the operationally ready state taken along section A-A shown in FIG. 7.

In FIG. 9 the contact pressure module 2 (shown in FIG. 1) is shown in the operationally ready state. The air bag 210—see also FIG. 2—protrudes with its upper part 2101 upward until the cover surface 21011 non-positively rests on the transport belt 10.

A compression spring 2064 is borne in a support pocket 213 in the upper part 201 and rests non-positively on a bearing point 20622 on the grip 2062 of the function arm 206, so this is always pushed back into the initial position.

The grip 2062 of the function arm 206 is pivoted by the compression spring 2064 around its bearing axle 208 downward until this rests non-positively with its sealing surface 20621 on the rubber elastic hose bushing 2051 that is inserted into the floor frame 205, and thus seals this air-tight (see Detail C). As a result of this, the fitted hose connector 2072 is also contained in the hose bushing 2051.

The tension springs 2052 are drawn far apart from one another by the inflated air bag 210—see Detail B—until the microswitch 2061 is triggered and a clearance from the floor plate 204 exists. The deactivation signal is directed from the microswitch 2061 via the circuit board 2017 with deactivation delay to the pump 209 and deactivates said pump 209 with a time delay (see also FIG. 7).

The lower part 2102 of the air bag 210 (shown in FIG. 5) rests on the floor plate 204 that, in turn, has a clearance from the shoulders 20531 at the guide clips 2053 that form the stop 20531 for travel limitation.

An approximately constant contact pressure with the transport belt 10 can be achieved—even for mixed mail—with greater tolerance (thickness and weight) with the combination of tension springs 2052 and elastic air bag 210. The heavier the letters that are permitted, the higher the spring constant that is selected.

Figure 10:
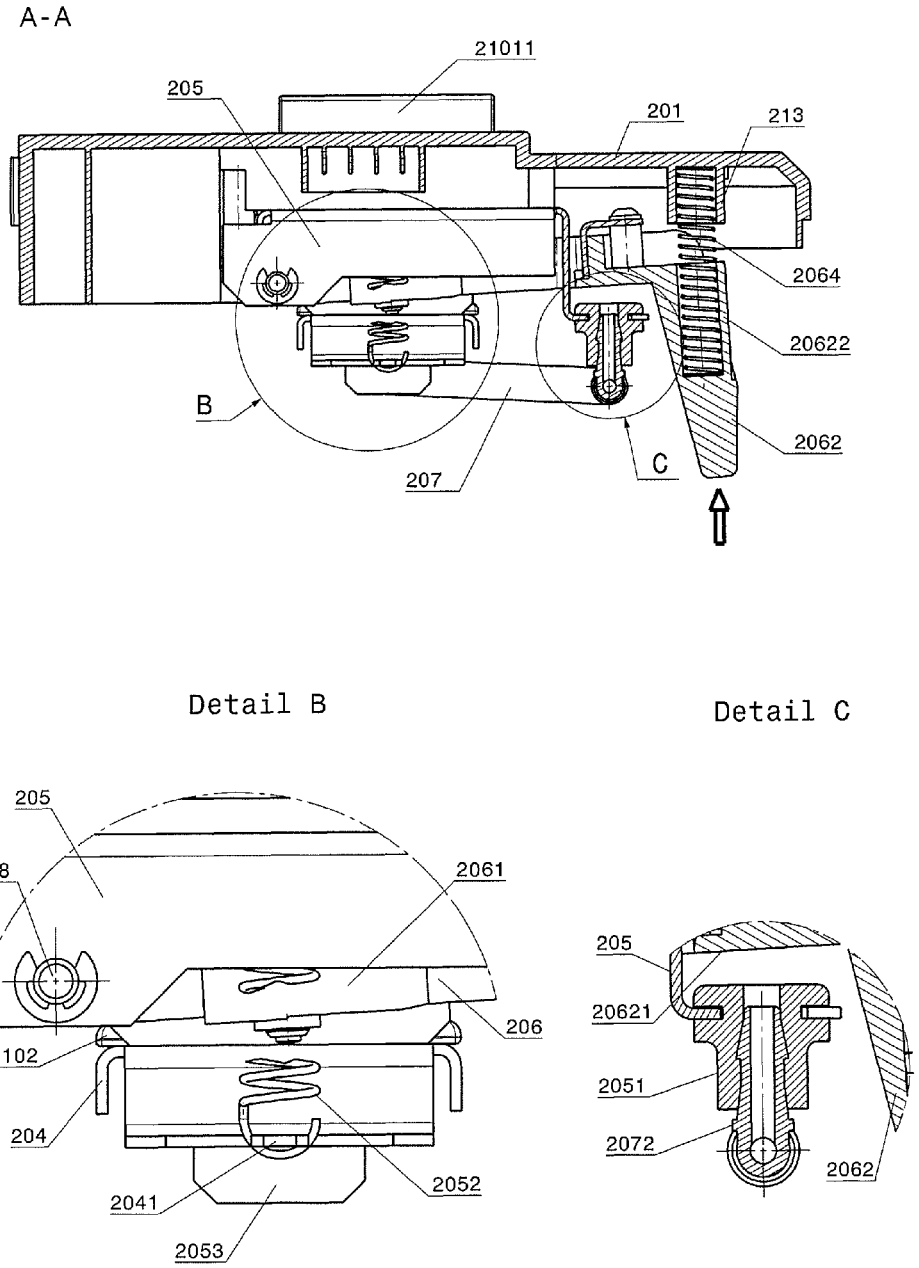
FIG. 10 shows an incremental cross-section presentation of the contact pressure module in a removal-ready state taken along section A-A shown in FIG. 7.

The contact pressure module 2 (shown in FIG. 1) in the removal-ready state is shown in FIG. 10. Upon raising (arrow) the grip 2062, the compression springs 2064 are compressed and the sealing surface 20621 assumes a clearance from the hose bushing 2051 in the floor frame 205 that is therefore open (see Detail C).

The air bag 210 (see also FIG. 2) is deflated and—with its upper part 2101—dips so far into the upper part 201 of the contact pressure module housing 20 that the cover surface 21011 has a clearance from the transport belt 10. The lower part 2102 of the air bag 210 is lowered until it rests on the floor plate 204, which in turn is drawn by the tension springs 2052 along the guide clips 2053 until it rests on their shoulders 20531. As a result of this, the trigger button (not designated in detail) of the microswitch 2061 is contacted to the greatest possible extent without triggering the latter. This means that the pump 209 remains deactivated.

Figure 11:
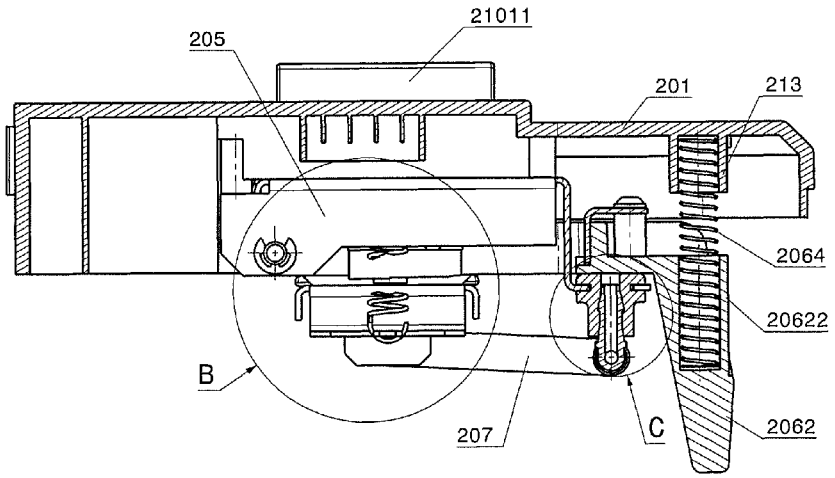
FIG. 11 shows an incremental cross-section presentation of the contact pressure module in the state before operational readiness taken along section A-A shown in FIG. 7.
Figure 11:
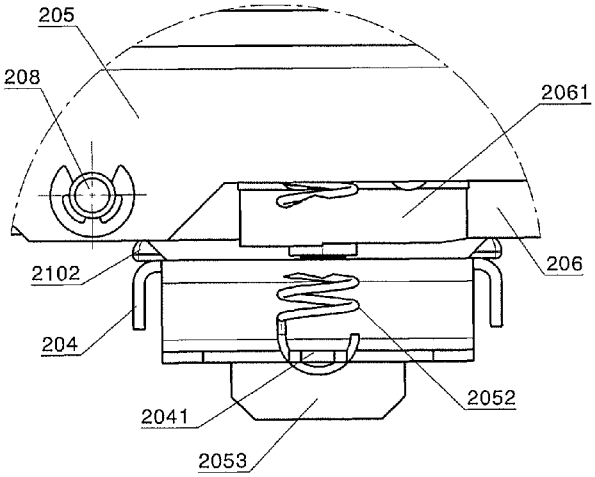
Figure 11:
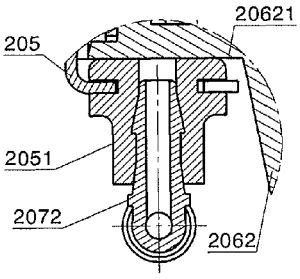

In FIG. 11, the contact pressure module 2 is shown before assuming operational readiness. The contact pressure module 2 is slid into the apparatus housing 01 (see also FIG. 1), and the grip 2062 of the function arm 206 is released (and therefore free). The spring force of the tension springs 2052 is measured so that the microswitch 2061 is triggered by the floor plate 204, and the pump 209 is activated with delay via the circuit board 2017 after the hose bushing 2051 has been sealed by the sealing surface 20621 of the grip 2062 of the function arm 206. The air bag 210 is inflated until operational readiness is established.

If a letter 4 arrives in the intake region (letter thickness sluice 02 shown in FIG. 1) of the franking machine 0, this initially strikes the wedge-shaped region of the cover surface 21011 and is slid by the running transport belt 10 into the contact pressure region of the air bag 210, and after passing is ejected by the same.

Due to the elastic properties—elastic air bag 210 and its suspension in the form of the floor plate 204 and the tension springs 2052—approximately the same contact pressure forces are achieved independent of the letter thickness, wherein the contact pressure force is even adjustable to the desired degree via the selection of the spring force.

If letters 4 of different thickness are simultaneously located in the contact pressure region of the air bag 210, due to its elastic properties said air bag 210 immediately adapts to these. The letters 4 of different thicknesses—thick after thin or vice versa—can follow one another at short intervals.

The contact pressure device 21 has proven itself precisely when an approximately 10 mm thick mail good follows a thin mail good of approximately 0.1 mm thickness, wherein the letter gap can be minimal. The minimal letter gap amounts to approximately 50 mm from the following mail good. The width of the contact pressure device 21 corresponds to the width of the transport belt, and the length of the contact pressure device 21 is smaller than or equal to the length of the straight segment of the transport belt.

The bellows has the advantage that an upward and downward expansion is enabled given a relative dimensional stability of its side walls. In the preceding description, a bellows has been addressed in simplified terms. However, a different suitable embodiment of a gas-tight casting that can be filled with air or with another suitable gas, which shell has a flexible contact pressure surface which can rapidly adapt its shape, should not therefore be precluded.

Instead of a bellows (bellows-shaped air bag), a flexible, inflatable, air-filled shaped part or, respectively, a shell can be used.

Although modifications and changes may be suggested by those skilled in the art, it is the intention of the inventors to embody within the patent warranted hereon all changes and modifications as reasonably and properly come within the scope of their contribution to the art.

We claim as our invention:

1. A printing apparatus comprising:

an apparatus housing having an upper part and a lower part;

a printing module in said lower part of said apparatus housing;

an actively driven rotating transport belt in said upper part of said apparatus housing, configured to transport flat articles to be printed past said printer module;

a movable contact pressure module in said lower part of said apparatus housing, said movable contact pressure module comprising a module housing having an opening therein that faces said transport belt, said movable contact pressure module being arranged with respect to said transport belt to cause said flat articles to be transported between said transport belt and said movable contact pressure module;

said movable contact pressure module comprising an expandable, bellows-like airbag that is resiliently mounted in said module housing, said airbag having a low-friction, wear-resistant cover surface that, through said opening in said module housing, is in non-positive contact with said transport belt; and air supply components in said module housing in fluid communication with an interior of said airbag, and configured to produce air pressure in said interior of said airbag that allows flat articles of different thicknesses to be transported between said cover surface of said airbag and said transport belt.

2. A printing apparatus as claimed in claim 1 wherein said cover surface of said airbag has a shape with a profile along a transport direction of said transport belt that initially rises toward said transport belt and is thereafter parallel to said transport belt, and has a gliding layer thereon, and wherein said movable contact pressure module comprises an intake region configured as a thickness sluice for said flat articles, said thickness sluice comprising a shaped part and a counterpart between which said flat articles pass in order to direct said flat articles between said transport belt and said cover surface of said airbag.

3. A printing apparatus as claimed in claim 1 wherein said airbag is a one-piece, unitary bag.

4. A printing apparatus as claimed in claim 1 wherein:

said airbag comprises an upper part and lower part conforming in shape with each other, and a plurality of lateral parts connecting said upper part and said lower part with all of said upper part, said lower part and said lateral parts being sealed airtight, said lateral parts comprising folds therein that allow a spacing between said upper part and said lower part to vary; and said air supply components include an air pump and a hose, and said lower part comprises a hose connection in a bottom exterior surface thereof that places said hose in fluid communication with said interior of said airbag.

5. A printing apparatus as claimed in claim 1 wherein said module housing comprises an upper module housing part and a lower module housing part, and wherein said airbag is attached to said upper module housing part, and is attached to a base frame in said lower module housing part via a function arm, said upper module housing part comprising a molded support pocket in which said pump is received, with said airbag resting on said bottom surface of said lower part on a base plate of said lower module housing part.

6. A printing apparatus as claimed in claim 5 wherein said airbag is mounted at a periphery of said airbag in said base frame, and wherein said base plate is resiliently mounted on said base frame with a vertical travel limitation, with a release or connection of said hose being integrated into said airbag, and wherein said hose is connected to said pump via a T-shaped hose connector, with a middle portion of said middle portion of said T-shaped hose connector projecting into an elastic hose bushing held at a non-zero angle with respect to said base frame.

7. A printing apparatus as claimed in claim 6 comprising tension springs that urge said base plate upwardly, and wherein said pump maintains said air pressure in said interior of said airbag to produce a substantially constant contact pressure of said cover surface of said airbag with said transport belt, and wherein said tension springs have a spring constant that is adjustable to adjust a magnitude of a contact pressure force produced by said contact pressure on said transport belt.

8. A printing apparatus as claimed in claim 5 wherein said function arm comprises a grip having a sealing surface for said hose bushing, and is mounted on a bearing axle allowing said function arm to rotate counter to a spring force in a direction of said hose bushing, and wherein said printing apparatus comprises a microswitch that activates said pump, said microswitch being attached to a side of said function arm, and wherein said pump is mounted with sound-damping mounting components.

9. A printing apparatus as claimed in claim 8 wherein said microswitch is connected to said pump via a circuit board that actuates said pump with an adjustable deactivation and activation delay with respect to activation of said microswitch.

10. A printing apparatus as claimed in claim 1 wherein said contact pressure module housing has an upper portion forming a travel surface for said flat articles.

11. A printing apparatus as claimed in claim 10 wherein the floor frame, at least two tension springs, the function arm with microswitch mounted thereupon, and a compression spring as a retention device are provided inside the housing of the mobile contact pressure module, the function arm is attached at its one end to the floor frame so as to be rotatable around the bearing axle, and at its other end is pressed against a first stop due to the spring force F1 of the compression spring in the operationally ready state of the mobile contact pressure module, wherein the function arm can be brought out of the stop given a movement counter to the action of the spring force F1 in the removal-ready state of the mobile contact pressure module, in that the contact pressure device has an elastic, inflatable, gas-tight shell with the upper part and the lower part, as well as a middle part, wherein the middle part is attached to the upper part of the housing of the contact pressure module, and the upper part of the shell protrudes through a window opening in the upper part, in that the floor plate is mounted at the floor of the lower part of the contact pressure device that the at least two tension springs are tensioned between the floor plate and the floor frame or the upper part, wherein the tension springs together exert a spring force F2 on the surface of the floor plate in order to drawn said floor plate onto stops for travel limitation, and therefore onto the microswitch, wherein said microswitch is activated as long as the spring force F2 is greater than or equal to the sum of pre-tension $F2_{pre}$ and the resulting force effect $F=\Delta P \cdot A$, with the gas pressure difference $\Delta P$ between internal gas pressure and external pressure, and with the active surface A of the shell, wherein the minimum contact pressure force of the contact pressure device is established by the pre-tension $F2_{pre}$ of the tension springs; and wherein an elastic constant c of the tension springs is selected which is equal to the quotient of the difference $\Delta F=F2_{max}-F2_{pre}$ and the maximum deflection $a_{max}$ of the floor plate, in that the circuit board is equipped with a time delay circuit arranged inside a housing, the circuit board has a power connection to supply said circuit board with an operating voltage in the inserted state of the mobile contact pressure module, and a connector for the electrical connection of an output of the time delay circuit with the contacts of a motor of a pump as well as a connector for the electrical connection of an input of the time delay circuit with the contacts of the microswitch, wherein the time delay circuit of the circuit board establishes an activation of the microswitch and outputs a time-delayed signal to the motor of the pump but remains unpowered in the state in which the mobile contact pressure module is removed; wherein, given a function arm brought into a stop, the pump is started with a time delay, and gas is pumped into the shell of the contact pressure device as long as the signal is output, wherein the operationally ready state of the mobile contact pressure module is set with a time delay, in that stops for travel limitation are provided at a predetermined distance D from the travel surface of the flat articles on the top part of the housing, wherein the activation of the microswitch is interrupted when the floor plate moves away from the stops and a minimum distance $a_{min}$ from said stops is thereby exceeded.

12. A printing apparatus as claimed in claim 11 wherein said first stop of said function arm is designed as a valve, and wherein said shell comprises a gas intake and outlet opening in the base of the lower part, said opening being connected via a hose connection with said valve for relieving gas over pressure in said shell.

13. A printing apparatus as claimed in claim 12 wherein said valve is a ventilation valve comprising a hose bushing with a sealing surface, said sealing surface being molded at a handle of said function arm.

14. A printing apparatus as claimed in claim 11 wherein said shell comprises sidewalls that are dimensionally stable, and wherein said cover surface serves as a contact pressure surface for said transport belt.

15. A printing apparatus as claimed in claim 14 wherein said cover surface has a width that is transverse to a transport direction of said transport belt that is less than or equal to a width of the transport belt, and has a length in said transport direction that is less than or equal to a length of a straight transport segment of said transport belt.

16. A printing apparatus as claimed in claim 11 wherein said motor is a direct current motor, and wherein said pump is an air piston pump or a membrane pump, and wherein said shell is designed as a bellows.

17. A printing apparatus as claimed in claim 11 wherein said time delay circuit has a separate adjustment for time delay of an activation delay and a deactivation delay.

18. A printing apparatus as claimed in claim 11 wherein said pretension $F2_{pre}$ of the tension springs is variable, and achieves the maximum spring tension $F2_{max}$ upon a maximum deflection $a_{max}$ of the tension springs, that is selected with respect to at least one of a maximum weight or a maximum dimension of the flat articles.

19. A printing apparatus as claimed in claim 1 wherein said lower part of said apparatus housing comprises guide rods, and wherein said contact pressure module housing comprises receptacles for said guide rods to allow insertion and removal of said contact pressure module with respect to said apparatus housing, and wherein said apparatus housing and said contact pressure module housing comprise mating electrical connections that transfer electrical power and signals between said apparatus housing and said contact pressure module housing.

20. A printing apparatus as claimed in claim 1 configured as a franking apparatus or an addressing apparatus.

* * * * *